United States Patent [19]

Rantapaa

[11] 4,450,733

[45] May 29, 1984

[54] PEDAL EXTENSION DEVICE

[76] Inventor: Larry A. Rantapaa, 1398 Grantham St., St. Paul, Minn. 55108

[21] Appl. No.: 308,264

[22] Filed: Oct. 5, 1981

[51] Int. Cl.[3] ..... G05G 1/16

[52] U.S. Cl. ..... 74/562; 84/231; 84/358

[58] Field of Search ..... 74/562, 562.5, 544, 74/481, 564; 84/230, 231, 232, 358

[56] References Cited

U.S. PATENT DOCUMENTS

| | | | |
|---|---|---|---|
| 811,279 | 1/1906 | Creighton et al. | 84/232 |
| 969,670 | 9/1910 | Stickel | 84/231 |
| 1,812,706 | 6/1931 | Mednikoff | 84/231 |
| 1,918,510 | 7/1933 | Woodall | 84/232 |

FOREIGN PATENT DOCUMENTS

| | | | |
|---|---|---|---|
| 10237 | of 1894 | United Kingdom | 84/231 |
| 19885 | of 1909 | United Kingdom | 84/232 |

*Primary Examiner*—Leslie A. Braun
*Assistant Examiner*—Frank McKenzie
*Attorney, Agent, or Firm*—Anthony G. Eggink

[57] ABSTRACT

An adjustable pedal extension device for the demountable attachment to a pedal of a machine, such as a piano, and which permits a user to manipulate an otherwise unreachable or difficult to reach foot pedal. The device includes a body frame having a supporting structure with an open end for receiving a pedal and an adjustable clamping member for securing the supporting structure to a pedal. A horizontal extension means is adjustably attached by a first securement means to the body frame, and a vertical extension means is adjustably secured to the horizontal extension means by a second securement means. The vertical extension means has a generally horizontal portion extending outward at its upper end to receive the foot of a user. The horizontal and vertical extension means are generally interchangeable L-shaped members having leg portions of varying lengths to effectuate a wide range of pedal extension distances. Further, a pedal adjustment means extends from the body frame to permit the removal or decrease of pedal play or ineffective pedal movement. Also included in the device are mounting, demounting, adjusting and securing features which permit the pedal extension device to be utilized without the requirement of tools.

15 Claims, 3 Drawing Figures

PEDAL EXTENSION DEVICE

This invention relates to a pedal extension device attachable to a foot pedal of a machine. Particularly, this invention relates to an adjustable pedal extension device for use on a foot pedal of a piano, and which permits the functionality of the pedal to be adjusted, in both the horizontal and vertical directions, to the reach of a piano players foot.

Pedal extension devices according to the invention are useful for the demountable securement to foot pedals of machines, and the like, to permit individuals having shorter than average legs to reach those pedals. The pedal extension devices are especially useful on foot pedals of a piano when played by children, in that the devices are easily adjusted to the foot reach of an individual child, and the devices can be continually adjusted in the horizontal and vertical directions as the foot reach of the child changes through leg growth. Additionally, the easy demountability of these devices permits all users or players access to the usage of the machines on which they are utilized.

Despite the longstanding need for a simple, easy to adjust pedal extension device for use on foot pedals of a machine, such as a piano, none in so far as is known has been developed. A practical, inexpensive, easy to install and adjust pedal extension device is provided by the teachings of this invention.

In summary, this invention provides an adjustable pedal extension device for the demountable attachment to a foot pedal of a machine, such as a piano. The device is comprised of a body frame, horizontal extension means, vertical extension means, first securement means for adjustably holding the horizontal extension means to the body frame, and second securement means for adjustably holding the vertical extension means to the horizontal extension means.

The body frame or body member of the pedal extension device includes a sleeve-type supporting structure having an open end for receiving a foot pedal of a machine, such as a piano. Within the interior of the supporting structure is a clamping member which is operationally adjustable from the exterior of the supporting structure, and which is for demountably securing the body frame to the pedal. A horizontal extension means projects horizontally from and vertically upward from the body frame and is adjustably and demountably secured thereto by a first securement means, a portion of which is attached to the body frame. A vertical extension means projects vertically upward and horizontally outward from the horizontal extension means and is adjustably held to the vertical portion of the horizontal extension means by a second securement means. The horizontally outward extending portion of the vertical extension means is for receiving the foot of a user of the pedal extension device. The vertical and horizontal extension means are preferably interchangeable L-shaped members, each having respectively different horizontal and vertical length portions so that a wide range of extension combinations can be effectuated.

Additionally provided by the invention is a pedal adjustment means which is attached to and extends upward from the body frame of the device. The pedal adjustment means has at least one adjustable vertical member extending therefrom for abutment against the frame of a machine, such as a piano, from which the pedal protrudes. The pedal adjustment means permits the user of the device to adjust the vertical member against the machine frame to force downward or suppress the pedal to which the device is attached until the slack or play in the pedal movement is removed.

In use, the adjustable pedal extension device is placed securedly on a pedal of a machine whereby the pedal is clamped within the body frame of the device. The device is then adjusted at its pedal adjustment means which suppresses the pedal as the vertical member is abutted against the frame of the machine. This adjustment is complete when further suppression of a pedal causes it to engage or function. Finally, the horizontal extension means is adjusted and secured to the body frame of the device by the first securement means, and the vertical extension means is adjusted and secured to the horizontal extension means by the second securement means. The latter adjustments are made so that the foot of a user comfortably meets the horizontal portion of the vertical extension means.

Other embodiments of the device include first securement means, second securement means, clamping member, and the vertical member of the pedal adjustment means being comprised of threaded shaft members with knobs capable of adjustment by hand, whereby the pedal extension device is able to be mounted, demounted, and adjusted without the need for tools. Additionally, other embodiments include padded element portions for the device to prevent damage to either the pedal or the machine on which the device of the invention is utilized, and pedal guide and abutment members located within the interior portion of the supporting structure of the body frame for aiding the placement and securement of the pedal therein.

These and other benefits of this invention will become clear from the following description by reference to the drawings, wherein.

Figure 1:
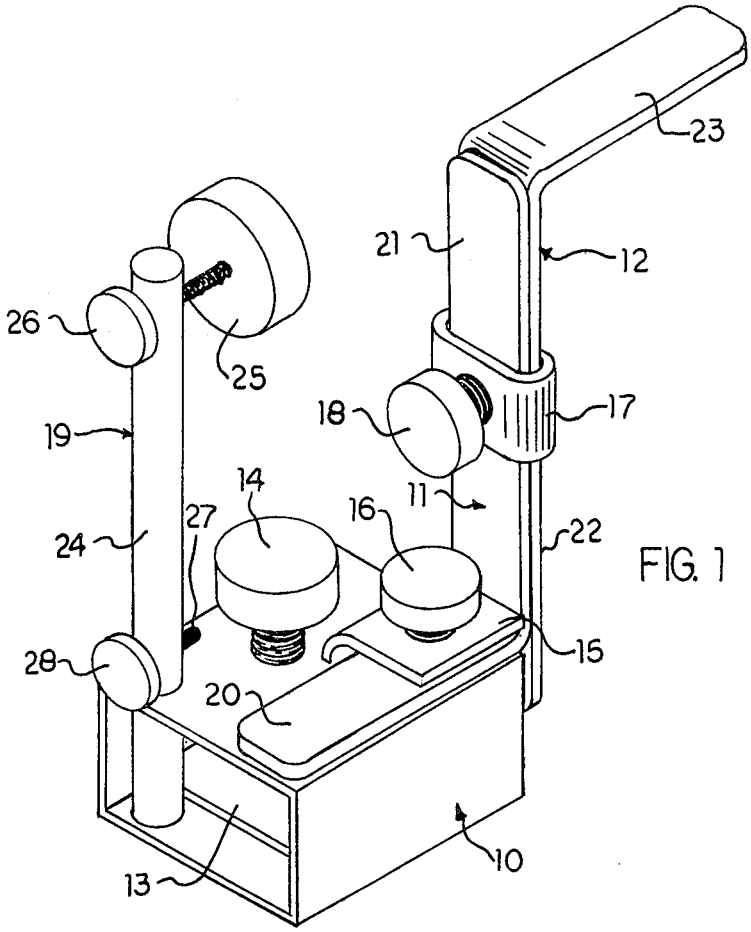
FIG. 1 is a schematic perspective view of a pedal extension device of the invention.
Figure 2:
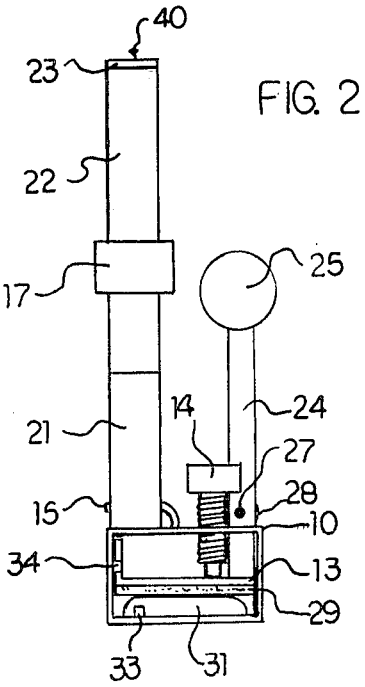
FIG. 2 is a schematic frontal view of a pedal extension device of the invention demountably secured to a pedal of a machine; and, FIG. 3 is a schematic side plan view of a pedal extension device of the invention secured to a pedal of a machine, and having a cut-away view of its body frame to illustrate the placement of a pedal therein.
Figure 3:
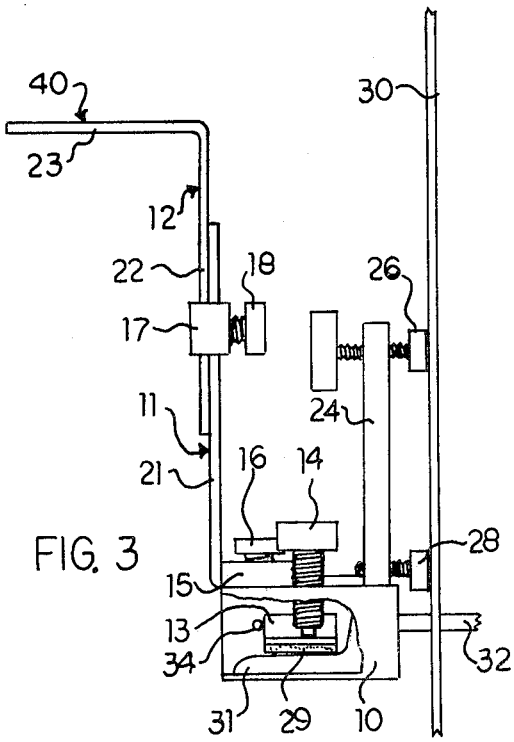

Referring to FIG. 1, an adjustable pedal extension device is illustrated having a body frame or body member 10, horizontal extension means 11 and vertical extension means 12. The body frame 10 consists of a generally rectilinear sleeve-type structure having opposing open ends. FIGS. 2 and 3 show the placement of the sleeve-type supporting structure about a foot pedal 31. The supporting structure of the body frame 10 is secured with respect to a pedal 31 by means of an adjustable clamping device consisting of an L-shaped clamping member 13 located within the interior of the supporting structure, and an adjustably, rotatable threaded shaft with knob 14. The threaded shaft with knob 14 has its knob portion located on the exterior portion of the body frame 10, whereby the end of the threaded shaft, which rotates through a threaded aperture in the top portion of the body frame 10, abuts clamping member 13 and secures a foot pedal to the bottom interior surface of the supporting structure. Thus, the clamping member 13 within the supporting structure is manipulated from the exterior of body frame 10 by means of rotating the knob portion of threaded shaft and knob 14. Additionally, a padded or cushioned layer portion 29, such as cork or plastic can be secured to the bottom surface of clamping member 13 so that portion 29 comes in contact with a pedal 31 to prevent damage, such as scratching, to the top surface of the pedal.

As shown in the drawings, the horizontal extension means 11 consists of a L-shaped member having a horizontal portion 20 and a vertical portion 21. And, vertical extension means 12 consists of an L-shaped member having a vertical portion 22 and a horizontal portion 23. A first securement means holds the horizontal extension means 11 to the top exterior surface of the supporting structure of body frame 10. As illustrated, the first securement means consists of a parallel plate member 15 which extends from or is connected to the top of body frame 10, and a threaded shaft with knob 16 which adjustably extends through a threaded aperture in the parallel plate member 15. The end of the threaded shaft with knob 16 is brought into contact with horizontal portion 20 as the knob is rotated in a predetermined direction which, thereby, secures the horizontal extension means in place relative to the top portion of body frame 10. As indicated above, the parallel plate member 15 can either extend congruously from the top of the supporting structure of body frame 10, or can be separate plate member which is fastened to the top surface of the supporting structure. Additionally, that portion of plate member 15 which extends parallel to that top surface can be connected to the supporting structure on one, two or even three sides as long as horizontal portion 20 of horizontal extension means can be securedly held thereby in conjunction with threaded shaft and knob 16. Obviously, the one or two sided connection of plate member 15 to the supporting structure would allow a greater degree of adjustability to the pedal extension device.

A second securement means which consists of a threaded apertured clamp member 17 and a threaded shaft with knob 18 is utilized to hold the vertical portion 22 of the vertical extension means 12 to the vertical portion 21 of horizontal extension means 11. The clamp member 17 has a longitudinally extending opening through which the vertical portion 21 of the horizontal extension means and the vertical portion 22 of the vertical extension means extend in a slidable relationship. Subsequent to aligning these respective portions 21 and 22 relative to each other, the knob of threaded shaft and knob 18 is tightened so as to secure the desired vertical extension of horizontal portion 23 of vertical extension means 12 relative to a pedal 31 secured within body frame 10.

As illustrated particularly in FIGS. 2 and 3, the pedal extension device is utilized by attaching it to a pedal 31 of a machine, shown generally as 30. For example, a machine 30, such as a piano, has operationally extending therefrom a pedal shaft 32 and a foot pedal 31 which receives the foot of a user of the machine. It would, however, be equally possible to utilize the device of the invention for a pedal normally pressed by the hand of a user. In the case of a piano, there may be three pedals used by a performer to control the range or volume of the sounds which are transmitted. For example, one pedal when depressed will cause all the dampers of the piano to be raised so that the strings continue to vibrate after the keys are released, while another pedal when depressed will shift the hammers to reduce the area of impact on the strings of the piano and thereby inhibiting the volume of sound. Another pedal, which does not exist in most upright pianos, is utilized to sustain only the tones held down at the moment the pedal is depressed. And, in some keyboard instruments, only a sustaining pedal may exist, while in other instruments, one or more of several pedals may be for decorative purposes. However, the proper utilization by suppression of operative pedals is extremely important to the performed of a piano. Unfortunately, this ability is difficult to those performers, such as children, since most pianos are designed for use by performers having an average leg reach. The device of this invention allows the effective foot suppressing area to be adjustably extended from the pedal area to the foot placement surface 40 of vertical extension means 12.

The preferred embodiment of the pedal extension device is also equipped with pedal adjustment means 19 which provides the user with means to reduce or remove the slack or ineffective depression distance of the pedal 31. As is common with most pedal devices, the engagement of the pedal does not immediately become effective for its intended purpose. And, because the pedal extension device of the invention allows the functionality of the pedal to be extended in a horizontally outward direction, this slack or ineffectiveness is accentuated. The pedal adjustment means 19 consists of a vertical shaft member 24, which is attached to the top of body frame 10, and at least one horizontally extending abutment member. The latter adjustably extends from shaft member 24, and consists of a threaded shaft 27 having a machine abutment pad 28, or of a threaded shaft with knob 25 having a machine abutment pad 26 attached to the threaded shaft opposite the knob. Either or both of the horizontally extending abutment members are adjustable through the rotation of their respective threaded shafts which extend through threaded apertures in the vertical shaft member 24. Although only one such machine abutment member is generally required for use, the upper member, as shown in the drawings, is best suited for use to adjust a pedal of an upright piano, while the lower member is best suited for use to adjust a grand piano pedal.

As can be seen with reference to FIG. 3, as either machine abutment member is rotated toward the piano or machine body 30, the pads 26 or 28, made of a cork, plastic or rubber material to prevent damage to the machine body, make contact with the machine frame body 30. Continued rotation of the abutment member causes a suppression or downward movement of pedal 31, and pedal adjustment becomes complete when the foot pedal 31 becomes operational.

In use, the adjustable pedal extension device is placed with the pedal 31 within the frame body 10 of the device. A pedal placement leg 33 extends upward from the interior bottom surface of the supporting structure of frame body 10, and which provides a means against which the pedal rests. The frame body 10 is then clamped or secured to pedal 31 by means of clamping member 13 and threaded shaft with knob 14, as previously described. The clamping member 13 is kept in place by a clamp member placement leg 34 which extends horizontally from the interior side surface of the supporting structure of body frame 10.

Subsequent to securing frame body 10 of the device to pedal 31, the pedal adjustment means 19 is utilized to remove the slack or inoperative distance of the pedal, as described above. Finally, the horizontal and vertical extension means, 11 and 12 respectively, are adjusted with respect to body frame 10 and with respect to each other, and then secured in place to comfortably meet the foot of the user or performer of the machine or piano. As described above, the horizontal and vertical extension means are preferably constructed of L-shaped members having varying leg length portions, so that the interchangeability of these means can provide a wide range of extension adjustability.

Preferably, the various components of the pedal extension device are manufactured of light weight materials such as aluminum, plastic, or metal alloys, so that the overall weight of the device has minimal effect upon the functionality of the pedal on which it is utilized. One such device, made of aluminum stock of approximately one eighth inch thickness, and designed for use on a pedal of a piano, utilized L-shaped extension members having dimensions for its leg lengths of 3½ and 7 inches, and 4 and 6 inches. Although the dimensions of the body frame 10 would depend upon the pedals on which the device would be utilized, one such structure having a length of 3½ inches, a width of 3 inches, and a height of 1¾ inches (when viewed from the top) was found well suited for use on the pedals of a piano.

Preferably, the adjustment and securement means of the device are such so that the device can be easily mounted onto and demounted from a pedal without the requirement of tools such as wrenches, pliers or screw drivers. Thus, the preferred embodiment of the device has knobs of elements 16, 14, 18 and 25 which are relatively large and have knurled or rough peripheral exteriors for hand grasping and turning. These features result in an easy adjustable, mountable and demountable device well suited for use by children learning the art of piano playing. And, the adjustability of the device allows a child to play a piano to an age when the device is no longer required for pedal reach, without impeding the accessibility of a piano to other performers; and, without harm or damage to the piano or pedal on which the device is utilized.

As many changes are possible to the embodiments of this invention utilizing the teachings of the invention, the descriptions above and the accompanying drawings should be interpreted in the illustrative and not in the limited sense.

That which is claimed is:

1. An adjustable pedal extension device for the demountable attachment to a foot pedal of a machine, said device comprising:

a. a body frame having an open end for receiving a pedal thereinto, said body frame further having an adjustable clamping member for securing said body frame to a pedal, said body frame additionally having pedal adjustment means extending generally upwardly therefrom for contact with a portion of the machine, said pedal adjustment means comprising a generally vertical member extending upward and attached to said body frame, and having at least one horizontally adjustable abutment member extending from said vertical member, said adjustable abutment member being a threaded shaft portion having a knob for turning at one end and having a padded member at the opposite end for abutment against a portion of the machine, said vertical member further having a threaded aperture therethrough for adjustably receiving said threaded shaft of said adjustable abutment member, b. horizontal extension means for extending at least a generally horizontal distance from said body frame, c. first securement means for adjustably holding said horizontal extension means to said body frame, d. vertical extension means for extending generally in the vertical direction relative to said body frame, said vertical extension means having a foot receiving portion extending therefrom, e. second securement means for adjustably holding said vertical extension means to said horizontal extension means, whereby, subsequent to securing said body frame to a pedal of a machine, said horizontal and vertical extension means are adjusted and secured by said first and second securement means to the reach of a user's foot to effectuate the manipulation of a pedal by the manipulation at said foot receiving portion of said vertical extension means by the foot of a user of said device, and, whereby, said pedal adjustment means is adjustably abutted against a portion of a machine to depress a pedal until the pedal becomes functionable, and to thereby remove any inoperative distance from the pedal.

2. The adjustable pedal extension device of claim 1 wherein said horizontal and vertical extension means are L-shaped members, each said L-shaped member being interchangeable for use by said other L-shaped member, and, wherein each said L-shaped member has two leg portions of unequal length relative to each leg portion length dimension and relative to the length dimensions of said other L-shaped member, whereby, the utilization of said L-shaped members permits a wide range of extension distance from a pedal on which said device is mounted.

3. The adjustable pedal extension device of claim 1 wherein said adjustable clamping member of said body frame has a threaded knob structure for adjusting said clamping member, said knob of said structure being operational from the exterior of said body frame, and wherein said first and second securement means are adjustable by second and third threaded knob structures respectively, whereby said the pedal extension device is mountable, demountable and adjustable by means of said threaded knob structures to permit a user of said device to do so by hand, without the requirement of tools.

4. The adjustable pedal extension device of claim 1 wherein said body frame is generally rectilinear sleeve structure having at least one open end for receiving a pedal, and wherein said adjustable clamping member is comprised of a padded plate member for placement on top of a pedal within the interior of said sleeve structure and a threaded shaft with knob structure for engagement with said padded plate member, said sleeve structure further having a threaded aperture at its top surface for receiving said threaded shaft with knob structure of said adjustable clamping member, whereby the adjustable clamping member is adjustable from the exterior of said sleeve structure by means of said knob.

5. The adjustable pedal extension device of claim 1 wherein said body frame, said horizontal and vertical extension means, said first and second securement means are made of a light weight material, such as aluminum or plastic.

6. The adjustable pedal extension device of claim 4 wherein said first securement means comprises a spacially parallel member secured to, and being spacially removed from, the top of said sleeve structure and a threaded knob structure, said parallel member having a threaded aperture for receiving said threaded knob structure, whereby said horizontal extension means is securable between the top of said sleeve structure and said parallel member by means of said threaded knob structure.

7. The adjustable pedal extension device of claim 6 wherein said second securement means comprises a generally oval ring structure having a threaded aperture therethrough and a threaded knob structure for threading thereinto, whereby said horizontal and said vertical extension means are adjustably secured by the simultaneous extension through said oval ring structure.

8. The adjustable pedal extension device of claim 1 wherein said device is for the demountable attachment to a foot pedal of a piano.

9. An adjustable pedal extension device for the demountable attachment to a foot pedal of a machine, said device comprising:

a. a body frame having an open end for receiving a pedal thereinto, said body frame further having an adjustable clamping member for securing said body frame to a pedal, said body frame being a generally rectilinear sleeve structure having at least one open end for receiving a pedal, and said adjustable clamping member being comprised of a padded plate member for placement on top of a pedal within the interior of said sleeve structure and a threaded shaft with knob structure for engagement with said padded plate member, said sleeve structure further having a threaded aperture at its top surface for receiving said threaded shaft with knob structure of said adjustable clamping member, whereby the adjustable clamping member is adjustable from the exterior of said sleeve structure by means of said knob, b. horizontal extension means for extending at least a generally horizontal distance from said body frame, c. first securement means for adjustably holding said horizontal extension means to said body frame, said first securement means comprising a rigid member being secured and spacially parallel to the top of said sleeve structure, and a threaded knob structure, said rigid, parallel member having a threaded aperture for receiving said threaded knob structure whereby said horizontal extension means is securable between the top of said sleeve structure and said parallel member by means of said threaded knob structure, d. vertical extension means for extending generally in the vertical direction relative to said body frame, said vertical extension means having a foot receiving portion extending therefrom, e. second securement means for adjustably holding said vertical extension means to said horizontal extension means, whereby, subsequent to securing said body frame to a pedal of a machine, said horizontal and vertical extension means are adjusted and secured by said first and second securement means to the reach of a user's foot to effectuate the manipulation of a pedal by the manipulation at said foot receiving portion of said vertical extension means by the foot of a user of said device.

10. The adjustable pedal extension device of claim 9 wherein said body frame has extending generally upwardly therefrom a pedal adjustment means for contact with a portion of a machine having a pedal, whereby, subsequent to attaching said pedal extension device to a pedal of a machine said pedal adjustment means is adjustably abutted against a portion of a machine to depress a pedal until a pedal become functionable, and to thereby remove the inoperative depression distance from a pedal.

11. The adjustable pedal extension device of claim 10, wherein said pedal adjustment means comprises a generally vertical member extending upward and attached to said body frame, and at least one horizontally adjustable abutment member extending from said vertical member, said adjustable abutment member being threaded shaft portion having a knob for turning at one end and having a padded member at the opposite end for abutment against a portion of a machine, said vertical member further having a threaded aperture therethrough for adjustably receiving said threaded shaft of said adjustable abutment member.

12. The adjustable pedal extension device of claim 9, wherein said horizontal and vertical extension means are L-shaped members, each said L-shaped member being interchangeable for use by said other L-shpaed member, and, wherein each said L-shaped member has two leg portions of unequal length relative to each leg portion length dimension and relative to the length dimensions of said other L-shaped member, whereby, the utilization of said L-shaped members permits a wide range of extension distance from a pedal on which said device is mounted.

13. The adjustable pedal extension device of claim 9 wherein said body frame, said horizontal and vertical extension means, said first and second securement means are made of a light weight material, such as aluminum or plastic.

14. The adjustable pedal extension device of claim 9 wherein said second securement means comprises a generally oval ring structure having a threaded aperture therethrough and a threaded knob structure for threading thereinto, whereby said horizontal and said vertical extension means are adjustably secured by the simultaneous extension through said oval ring structure.

15. The adjustable pedal extension device of claim 9 wherein said device is for the demountable attachment to a foot pedal of a piano.

* * * * *